US008223137B2

(12) United States Patent
Hong

(10) Patent No.: US 8,223,137 B2
(45) Date of Patent: Jul. 17, 2012

(54) LIQUID CRYSTAL DISPLAY DEVICE AND METHOD FOR DRIVING THE SAME

(75) Inventor: Young Gi Hong, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 1258 days.

(21) Appl. No.: 11/638,439

(22) Filed: Dec. 14, 2006

(65) Prior Publication Data

US 2008/0143662 A1 Jun. 19, 2008

(51) Int. Cl.
*G09G 5/00* (2006.01)

(52) U.S. Cl. ..... 345/204; 345/87; 345/92; 345/211; 345/214

(58) Field of Classification Search ..... 345/36, 345/38–39, 46, 50–55, 67, 87–96, 99–100, 345/204–206
See application file for complete search history.

(56) References Cited

U.S. PATENT DOCUMENTS 5,602,560 A * 2/1997 Ikeda ..... 345/94
5,945,970 A * 8/1999 Moon et al. ..... 345/92
6,107,857 A * 8/2000 Orisaka et al. ..... 327/333
6,219,016 B1 * 4/2001 Lee ..... 345/87
6,255,888 B1 * 7/2001 Satomi ..... 327/333
6,369,516 B1 * 4/2002 Iketsu et al. ..... 315/169.3
6,421,038 B1 * 7/2002 Lee ..... 345/98
6,593,920 B2 * 7/2003 Okumura et al. ..... 345/204
6,670,939 B2 * 12/2003 Yang et al. ..... 345/98
6,903,734 B2 * 6/2005 Eu ..... 345/211
7,129,921 B2 * 10/2006 Yeon et al. ..... 345/89
7,271,801 B2 * 9/2007 Toyozawa et al. ..... 345/211
7,327,338 B2 * 2/2008 Moon ..... 345/87
7,499,009 B2 * 3/2009 Kanbe et al. ..... 345/87
7,602,364 B2 * 10/2009 Shih et al. ..... 345/98
7,679,595 B2 * 3/2010 Luo et al. ..... 345/98
7,830,350 B2 * 11/2010 Joo ..... 345/99
7,944,440 B2 * 5/2011 Park ..... 345/211
7,944,727 B2 * 5/2011 Kurjanowicz ..... 365/96
2001/0009411 A1 * 7/2001 Kusanagi ..... 345/93
2001/0013850 A1 * 8/2001 Sakaguchi et al. ..... 345/87
2005/0062706 A1 * 3/2005 Mizumaki ..... 345/94
2007/0075750 A1 * 4/2007 Woo et al. ..... 327/77

* cited by examiner

*Primary Examiner* — Nitin Patel
*Assistant Examiner* — Mansour M Said
(74) *Attorney, Agent, or Firm* — Morgan, Lewis & Bockius LLP

(57) ABSTRACT

An liquid crystal display (LCD) device includes an LCD panel provided with a plurality of pixels, wherein the pixels are defined by a plurality of gate and data lines formed perpendicularly, an auxiliary storage capacitor formed in each of the pixels, a gate driver to drive the gate lines in sequence by supplying a scan pulse voltage to the gate lines of the LCD panel, wherein the scan pulse voltage is comprised of a high gate voltage and a low gate voltage, and a discharger to supply a pulse voltage to the gate line based on a source voltage for operating the LCD panel, wherein the discharger enables the auxiliary storage capacitor to be discharged to the ground voltage as the voltage of the gate line approaches the ground voltage.

5 Claims, 8 Drawing Sheets

LIQUID CRYSTAL DISPLAY DEVICE AND METHOD FOR DRIVING THE SAME

BACKGROUND OF THE INVENTION

1. Field of the Invention

The present invention relates to a liquid crystal display (LCD) device and a method for driving the same, and more particularly, to an LCD device that can remove residual images from a screen by rapidly discharging a low gate voltage applied to a gate line and a method for driving the same.

2. Discussion of the Related Art

Generally, LCD devices display images by controlling light transmittance through liquid crystals by controlling the electric field in the liquid crystal cells. The LCD device includes an LCD panel that is provided with liquid crystal cells arranged in a matrix configuration and a driving circuit that drives the LCD panel. The LCD panel includes a thin film transistor (TFT) that is formed adjacent to each crossing of gate and data lines and a pixel electrode that is connected to the TFT. The TFT includes a gate electrode that is connected to any one of the gate lines by each horizontal pixel-line and a source electrode that is connected to any one of the data lines by each vertical pixel-line. The TFT supplies a data signal from the data line to the pixel in response to a gate driving pulse of the gate line.

The pixel has a pixel electrode that is connected to a drain electrode of the TFT, a common electrode that faces the pixel electrode, and a liquid crystal layer disposed therebetween. The pixel drives the liquid crystal in response to the data signal supplied to the pixel electrode, thereby controlling the light transmittance. Hereinafter, a related art LCD device will be explained with reference to the accompanying drawings.

FIG. 1 is a circuit diagram illustrating one pixel of an LCD device according to the related art. As shown in FIG. 1, each pixel of the LCD device is defined by a gate line (GL) and a data line (DL) that are formed perpendicularly. Each pixel includes a TFT and a pixel electrode. In particular, the TFT is formed adjacent to each crossing of the gate and data lines (GL, DL). Also, the TFT includes a gate terminal connected to the gate line (GL), a source terminal connected to the data line (DL), and a drain terminal connected to the pixel electrode 160.

The LCD device includes first and second glass substrates being bonded to each other and a liquid crystal layer formed between the two glass substrates. FIG. 1 shows one pixel formed on the first substrate of a TFT array substrate. Although not shown, the second substrate includes an R/G/B color filter layer that represents various colors and a common electrode 150 that displays images. The pixel electrode 160 is provided facing the common electrode 150. A liquid crystal layer is disposed between the pixel electrode 160 and the common electrode 150. Based on the intensity of the electric field between the pixel electrode 160 and the common electrode 150, the light transmittance through the liquid crystal can be controlled.

A storage capacitor (Clc) is formed by the common electrode 150, the pixel electrode 160, and the liquid crystal layer. The common electrode 150 functions as a first electrode of the storage capacitor (Clc). The pixel electrode 160 functions as a second electrode of the storage capacitor (Clc). The liquid crystal layer functions as a dielectric of the storage capacitor (Clc). Each pixel electrode 150 partially overlaps with the gate line (GL) to drive the adjacent pixel. An insulator is provided between the pixel electrode 160 and the gate line (GL). The overlapping portion between the gate line (GL) and the pixel electrode 160 functions as an auxiliary storage capacitor (Cst). A predetermined portion of the pixel electrode 160 functions as a first electrode of the auxiliary storage capacitor (Cst). A predetermined portion of the gate line (GL) functions as a second electrode of the auxiliary storage capacitor. The insulator functions as a dielectric of the auxiliary storage capacitor. Each pixel electrode 160 overlaps with the gate line (GL) of the adjacent pixel, which is referred to as a previous gate structure.

An operation of the above-mentioned pixel will be explained as follows. First, the TFT is turned-on when a high gate voltage is applied to the gate line (GL). Once the TFT is turned-on, a data voltage of the data line (DL) is supplied to the pixel electrode 160. Accordingly, the storage capacitor (Clc) is charged with a predetermined voltage, i.e., a voltage corresponding to the difference between the data voltage applied to the pixel electrode 160 and the voltage applied to the common electrode 150.

On the other hand, the TFT is turned-off when a low gate voltage is applied to the gate line (GL). When the TFT is turned-off, the storage capacitor (Clc) is not being charged. However, the voltage of the storage capacitor (Clc) maintains the previous voltage. Accordingly, the gray scale of the frame is maintained. However, within a predetermined time after the TFT is turned-off, a voltage drop occurs between both terminals of the storage capacitor due to leakage of current. Since the auxiliary storage capacitor (Cst) is also charged, this predetermined time is determined by the natural exponential decay rate of the auxiliary storage capacitor (Cst). In other words, the voltage drop is not rapid.

FIG. 2 is a graph of illustrating the voltage-current properties of a TFT according to the related art. As shown in FIG. 2, when the high gate voltage (VGH) is applied to the gate terminal of the TFT, the TFT is in the on-current (Ion) state. In this state, the voltage of the source terminal is applied to the storage capacitor (Clc). When the low gate voltage (VGL) is applied to the gate terminal of the TFT, the TFT is in the off-current (Ioff) state. In this state, the electric charges of the storage capacitor (Clc), which were charged when the high gate voltage (VGH) was applied to the gate terminal, are not discharged to the outside.

However, the related art LCD device has the following disadvantages when the source voltage is blocked after the driving the related art LCD device. Just before blocking the source voltage of the LCD device, a low gate voltage (VGL) is applied to most of gate lines (GL). In other words, a high gate voltage (VGH) is applied to only one gate line that is selected and a low gate voltage (VGL) is supplied to other gate lines except for the one selected. Therefore, the low gate voltage (Voff) is applied to the gate terminals provided in most of the TFTs. For LCD devices according to the related art, the auxiliary storage capacitor (Cst) is charged with the low gate voltage (VGL). Accordingly, until discharging the low gate voltage (VGL) from the auxiliary storage capacitor (Cst) to reach a ground voltage, a low gate voltage (VGL) is applied to the gate terminal of the TFT. Accordingly, it is impossible to make the prompt response of removing the displayed image. In other words, since the auxiliary storage capacitor (Cst) is maintained with the low gate voltage (VGL), it is difficult to promptly discharge the auxiliary storage capacitor. For this reason, the related art LCD device using the previous gate structure has the residual image after the source voltage is blocked.

SUMMARY OF THE INVENTION

Accordingly, the present invention is directed to a liquid crystal display device and a method of driving the same that substantially obviates one or more problems due to limitations and disadvantages of the related art.

An object of the present invention is to provide an LCD device and a method for driving the same, in which a low gate voltage applied to a gate line rapidly discharges to a ground voltage by applying a high gate voltage to the gate line, thereby removing residual images from the screen.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the liquid crystal display device includes an LCD panel provided with a plurality of pixels, wherein the pixels are defined by a plurality of gate and data lines formed perpendicularly, an auxiliary storage capacitor formed in each of the pixels, a gate driver to drive the gate lines in sequence by supplying a scan pulse voltage to the gate lines of the LCD panel, wherein the scan pulse voltage is comprised of a high gate voltage and a low gate voltage, and a discharger to supply a pulse voltage to the gate line in response to a source voltage for operating the LCD panel, wherein the discharger enables the auxiliary storage capacitor to be discharged to the ground voltage as the voltage of the gate line approaches the ground voltage.

In another aspect, a method for driving an LCD device including an LCD panel comprises discharging an auxiliary storage capacitor by supplying a pulse voltage to a gate line in response to a source voltage for operating the LCD panel so that the auxiliary storage capacitor is discharged to the ground voltage, wherein the discharge is faster than a natural exponential decay rate of the auxiliary storage capacitor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, an LCD device according to the present invention will be described with reference to the accompanying drawings.

Figure 1:
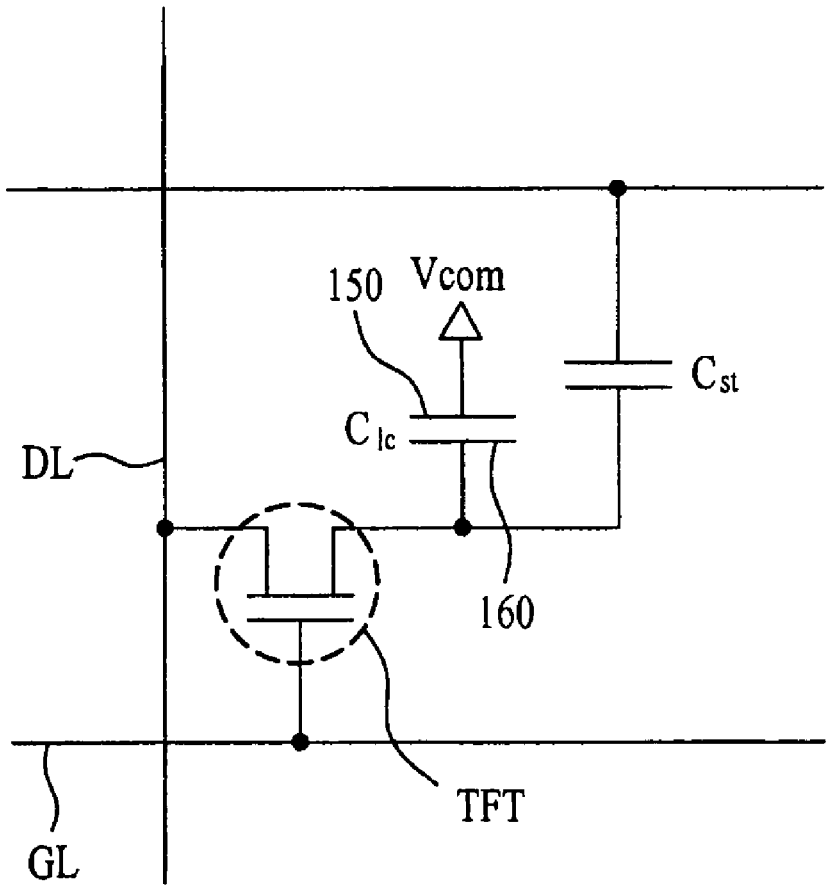
FIG. 1 Related Art
FIG. 1 is a circuit diagram illustrating one pixel of an LCD device according to the related art.
Figure 2:
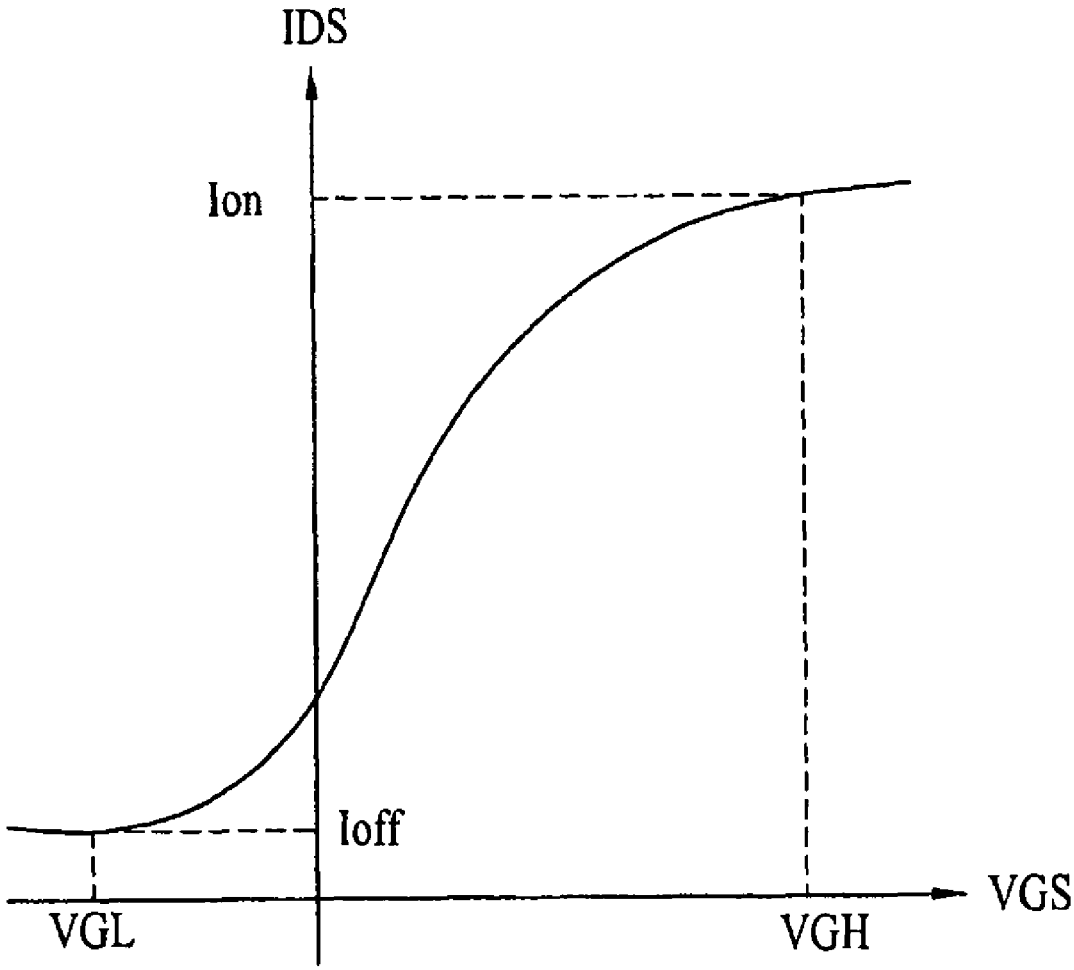
FIG. 2 Related Art
FIG. 2 is a graph of illustrating the voltage-current properties of a TFT according to the related art.
Figure 3:
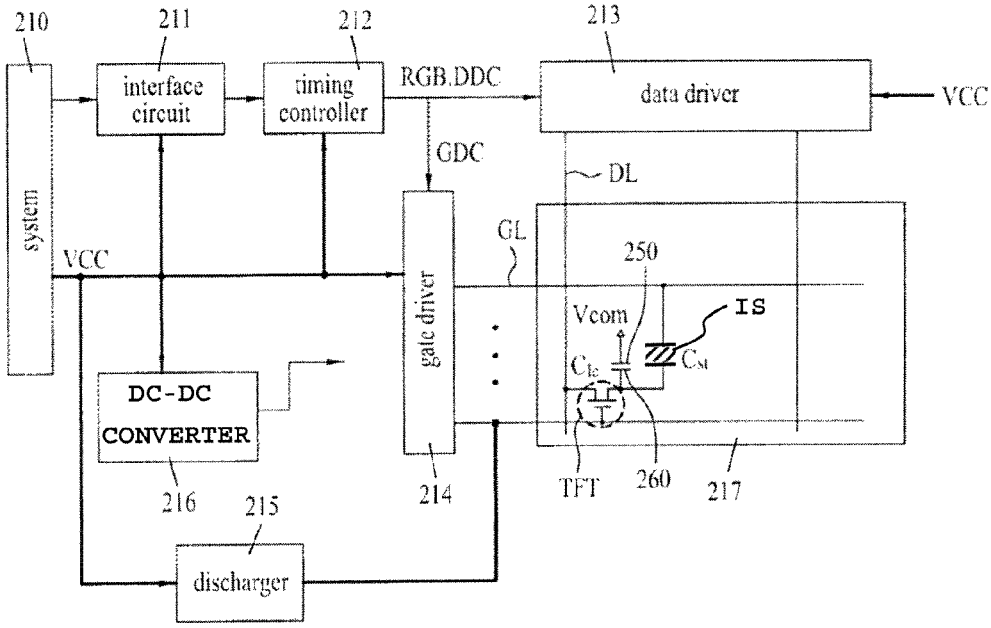
FIG. 3 is a diagram illustrating an LCD device according to an exemplary embodiment of the present invention.
Figure 4:
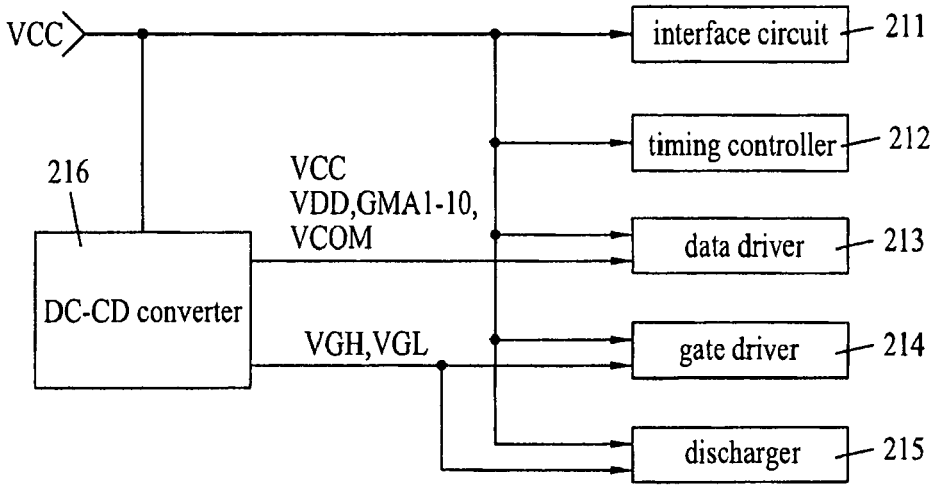
FIG. 4 is a diagram illustrating a transmission pass of source voltage in FIG. 3.

FIG. 3 is a diagram illustrating an LCD device according to an exemplary embodiment of the present invention. FIG. 4 is a diagram illustrating a transmission pass of source voltage in FIG. 3. As shown in FIG. 3, the LCD device according to the exemplary embodiment of the present invention includes an LCD panel 217, a data driver 213, a gate driver 214, a timing controller 212, a DC-DC converter 216, and a discharger 215. In detail, the LCD panel 217 includes 'm*n' pixels that are arranged in a matrix configuration and are defined by 'm' data lines (DL) and 'n' gate lines (GL) formed perpendicularly and a TFT that is formed adjacent to each crossing of the gate and data lines. Also, the data driver 213 supplies a data voltage to the data line (DL) of the LCD panel 217. The gate driver 214 supplies a scan pulse voltage, which includes a low gate voltage VGL and a high gate voltage VGH, to the gate line (GL). Then, the timing controller 212 controls the data driver 213 and the gate driver 214 by using a synchronized signal of an interface circuit 211. The DC-DC converter 216 receives a source voltage (VCC) from a system 210 and generates voltages supplied to the LCD panel 217. The discharger 215 determines the turning-on/off state of the LCD device by sensing whether the system 210 outputs the source voltage (VCC) or not and supplies a pulse voltage to the gate line (GL), wherein the pulse voltage is higher than the low gate voltage (VGL) applied to the gate line (GL), to make the gate line (GL) discharge to the ground voltage (GND).

The system 210 supplies vertically/horizontally synchronized signals, a clock signal, and data (RGB) to the interface circuit 211 through an LVDS (Low Voltage Differential Signaling) transmitter of a graphic controller. The system 210 also supplies the source voltage (VCC) of 3.3V generated from a power source to the interface circuit 211, timing controller 212, data driver 213, gate driver 214, discharger 215, and the DC-DC converter 216.

Each pixel of the LCD panel 217 is defined by the gate and data lines (GL, DL) that are formed perpendicularly. Each pixel includes the TFT and a pixel electrode 260. The TFT is formed adjacent to each crossing of the gate and data lines (GL, DL). The TFT includes a gate terminal connected to the gate line (GL), a source terminal connected to the data line (DL), and a drain terminal connected to the pixel electrode 260. The LCD panel 217 includes first and second glass substrates that are bonded to each other and a liquid crystal layer formed between the two glass substrates. FIG. 3 shows the first substrate corresponding to a TFT array substrate.

Although not shown, the second substrate is provided opposite to the first substrate. The second substrate includes an R/G/B color filter layer that represents various colors and a common electrode 250 that represents images. The pixel electrode 260 of the first substrate faces the common electrode 250, and a liquid crystal layer is disposed therebetween. By controlling the intensity of the electric field between the pixel electrode 260 and the common electrode 250, it is possible to control the light transmittance of liquid crystal.

The pixel also includes a storage capacitor (Clc) including the common electrode 250, the pixel electrode 260, and the liquid crystal layer (not shown). The common electrode 250 functions as a first electrode of the storage capacitor (Clc). The pixel electrode 260 functions as a second electrode of the storage capacitor (Clc). The liquid crystal layer functions as a dielectric of the storage capacitor (Clc).

Also, each pixel electrode 250 partially overlaps with the gate line (GL) to drive the adjacent pixel. An insulator (IS) is provided between the pixel electrode 260 and the gate line (GL). The overlapping portion between the gate line (GL) and the pixel electrode 260 functions as an auxiliary storage capacitor (Cst).

A predetermined portion of the pixel electrode 260 functions as a first electrode of the auxiliary storage capacitor (Cst). Also, a predetermined portion of the gate line (GL) functions as a second electrode of the auxiliary storage capacitor (Cst). The insulator (IS) functions as a dielectric of the auxiliary storage capacitor (Cst). Each pixel electrode 260 overlaps with the gate line (GL) of the adjacent pixel.

The data driver 213 converts the digital video data (RGB) to an analog gamma voltage of a corresponding gray scale in response to a data control signal (DDC) outputted from the timing controller 212. Then, the data driver 213 supplies the analog gamma voltage to the data line (DL). Also, the source voltage (VCC) is supplied to a data driving IC on which the data driver 213 is mounted.

The gate driver 214 sequentially supplies a scan pulse voltage to the gate line (GL) in response to a gate control signal (GDC) outputted from the timing controller 212. Then, the gate driver 214 selects a corresponding horizontal line of the LCD panel 217 supplied with the data voltage. Also, the source voltage (VCC) is supplied to a gate driving IC on which the gate driver 214 is mounted.

The timing controller 212 generates the gate control signal (GDC) and the data control signal (DDC) by using the vertically/horizontally synchronized signals and the clock signal outputted from the graphic controller of the system 210 through the interface circuit 211.

The DC-DC converter 216 raises or lowers the source voltage (VCC) outputted from the system 210 through a connector (not shown), and supplies the raised or lowered source voltage (VCC) to the LCD panel 217. The DC-DC converter 216 includes an output switching element that switches an output voltage for an output terminal. The DC-DC converter 216 further includes a pulse frequency modulator (PFM) or pulse width modulator (PWM) that raises or lowers the output voltage by controlling a frequency of a duty ratio of a control signal of the output switching element. The pulse width modulator (PWM) raises the output voltage of the DC-DC converter 216 by increasing the duty ratio of the control signal of the output switching element, or lowers the output voltage of the DC-DC converter 216 by decreasing the duty ratio of the control signal of the output switching element. Also, the pulse frequency modulator (PFM) raises the output voltage of the DC-DC converter 216 by increasing the frequency of the control signal of the output switching element, or lowers the output voltage of the DC-DC converter 215 by decreasing the frequency of the control signal of the output switching element.

The output voltage of the DC-DC converter 216 corresponds to a reference voltage (VDD), which is a voltage above 6V, gamma reference voltages (GMA1~10) of 10 levels or less, a common voltage (VCOM) of 2.5~3.3V, a high gate voltage (VGH) of above 15V, and a low gate voltage (VGL) of below −4V. The gamma reference voltages (GMA1~10) are generated by dividing the reference voltage (VDD).

The reference voltage (VDD) and the gamma reference voltages (GMA1~10) are supplied to the data driver 213, wherein the reference voltage (VDD) and the gamma reference voltages (GMA1~10) correspond to the analog gamma voltages. The common voltage (VCOM) is supplied to the common electrode 250 of the LCD panel 217 through the data driver 213. The high gate voltage (VGH) is supplied to the gate driver 214. The high gate voltage (VGH) is a high logic voltage of a scan pulse voltage that is set above a threshold voltage of the TFT. The low gate voltage (VGL) is supplied to the gate driver 214. The low gate voltage (VGL) is a low logic voltage of a scan pulse voltage that is set by a turn-off voltage of the TFT. Also, the high gate voltage (VGH) and low gate voltage (VGL) outputted from the DC-DC converter 216 are supplied to the discharger 215.

Figure 5:
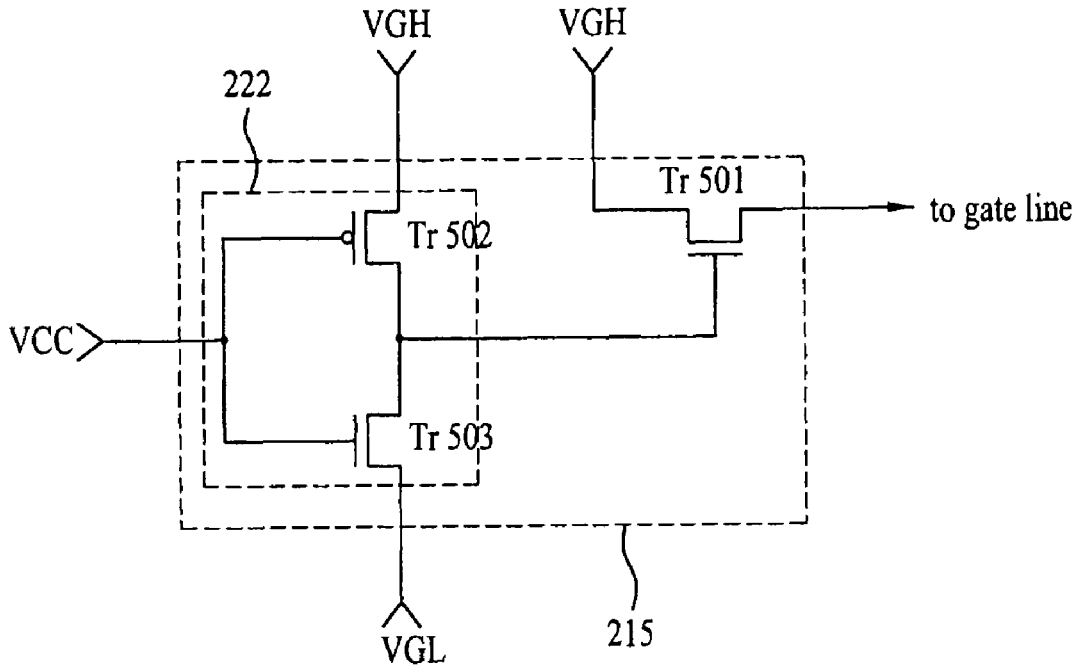
FIG. 5 is a diagram illustrating a first exemplary embodiment of the discharger according to the present invention.

The discharger 215 will be explained in detail. FIG. 5 is a diagram illustrating a first exemplary embodiment of the discharger according to the present invention. The discharger 215 includes an inverter 222 that outputs the high gate voltage (VGH) or low gate voltage (VGL) based on the intensity of the source voltage (VCC) and a first NMOS transistor (Tr501) that is turned-on in response to the high gate voltage (VGH) outputted from the inverter 222, to thereby apply the high gate voltage (VGH) to the gate line (GL).

The inverter 222 includes a PMOS transistor (Tr502) and a second NMOS transistor (Tr503). In detail, the PMOS transistor (Tr502) includes a gate terminal having the source voltage (VCC) applied thereto and a source terminal to which the high gate voltage (VGH) outputted from the DC-DC converter 216 is applied. The second NMOS transistor (Tr503) includes a gate terminal connected to the gate terminal of the PMOS transistor (Tr502), a source terminal connected to the drain terminal of the PMOS transistor (Tr502), and a drain terminal to which the low gate voltage (VGL) outputted from the DC-DC converter 216 is applied.

The first NMOS transistor (Tr501) includes a gate terminal to which the high gate voltage (VGH) outputted from the drain terminal of the PMOS transistor 502 or the low gate voltage (VGL) outputted from the drain terminal of the second NMOS transistor (Tr503) is applied, a source terminal to which the high gate voltage (VGH) outputted from the DC-DC converter 216 is applied, and a drain terminal connected to the gate line (GL).

The scan pulse voltage outputted from the gate driver 214 is applied to the gate line (GL), wherein the scan pulse voltage is comprised of the high gate voltage (VGH) and the low gate voltage (VGL). As the high gate voltage (VGH) and the low gate voltage (VGL) are applied to the gate driver 214, the gate driver 216 selects the corresponding gate line (GL) in response to the control signal outputted from the timing controller 212, and outputs the high gate voltage (VGH) to the selected gate line (GL), thereby driving the selected gate line (GL). Then, the gate driver 214 supplies the low gate voltage (VGL) to the other gate lines (GL) except the one selected (GL). In particular, the gate driver 214 selects the gate lines (GL) in sequence, and supplies the high gate voltage (VGH) to the selected gate line (GL). Accordingly, the high gate voltage (VGH) is supplied to each gate line (GL) in sequence. As mentioned above, the low gate voltage (VGL) is supplied to the other gate lines (GL) except the selected gate line (GL) having the high gate voltage (VGH) applied thereto.

A driving method of the LCD device according to the preferred embodiment of the present invention will be explained as follows. First, if a user pushes a power switch (for example, a display device or monitor), the LCD device is turned-on. Thus, the source voltage (VCC) having the predetermined value is applied to the DC-DC converter 216 and the discharger 215 from the system 210. Generally, the source voltage (VCC) corresponds to 3.3V.

Then, the DC-DC converter 216 raises or lowers the source voltage (VCC) to output the driving voltage including the high gate voltage (VGH) and the low gate voltage (VGL). In particular, the high gate voltage (VGH) and the low gate voltage (VGL) are outputted from the DC-DC converter 216, and are inputted to the gate driver 214 and the discharger 215.

The gate driver 214 generates the scan pulse voltage by switching the high gate voltage (VGH) and the low gate voltage (VGL) through the use of PWM, and sequentially supplies the scan pulse voltage to the gate lines (GL) to drive the gate lines (GL) in sequence. In other words, the gate driver 214 supplies the high gate voltage (VGH) to the gate lines (GL) in sequence. However, the high gate voltage (VGH) is supplied to one selected gate line, and the low gate voltage is supplied to the other gate lines except the selected one. Accordingly, only one gate line (CL) is driven at a time.

The image is displayed on the pixels for one horizontal line that are arranged along the gate line (GL) to which the high gate voltage (VGH) is applied. As the source voltage (VCC) is applied to the discharger 215 from the system 210, the discharger 215 is operated as follows. When the LCD device is turned-on, the source voltage (VCC) having the predetermined value is applied to the discharger 215. The source voltage (VCC) is applied to the gate terminal of the PMOS transistor (Tr502) and the gate terminal of the second NMOS transistor (Tr503) at the same time.

Then, the PMOS transistor 502 is turned-off in response to the intensity of the source voltage (VCC) having a predetermined voltage of the positive polarity. Meanwhile, the second NMOS transistor (Tr503) is turned-on in response to the source voltage (VCC) having a predetermined voltage of the positive polarity. The low gate voltage (VGL) is applied to the gate terminal of the first NMOS transistor (Tr501) through the source and drain terminals of the second NMOS transistor (Tr503) that is turned-on. Here, the low gate voltage (VGL) is the negative polarity. Accordingly, the first NMOS transistor (Tr501) is turned-off.

If the LCD device is turned-on, the image is displayed on the LCD panel 217. In this case, the discharger 215 doesn't apply the voltage to the gate lines (GL). That is, on the normal driving state of displaying the image in the LCD panel 217, the voltage is not supplied to the gate line (GL), whereby the LCD device is normally driven. This is because the first NMOS transistor (Tr501) provided in the discharger 215 is turned-off.

Figure 6:
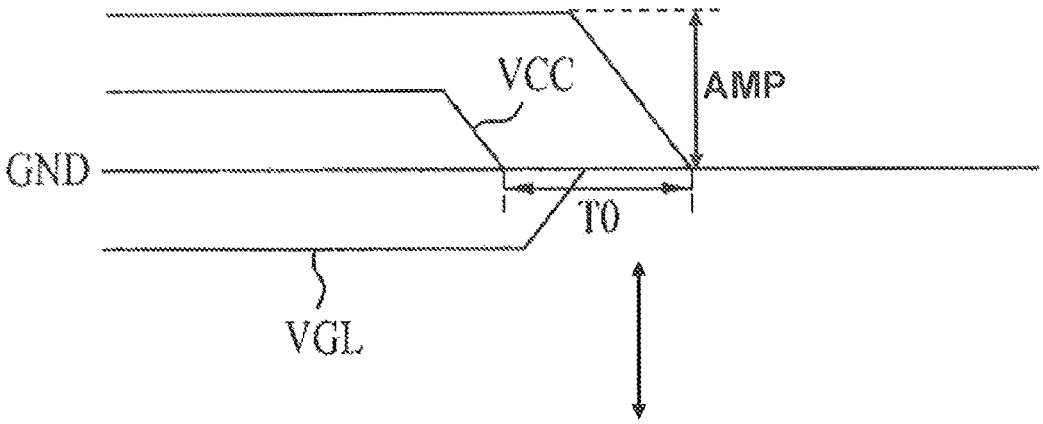
FIG. 6 shows a point of time in which each of a source voltage, a high gate voltage, and a low gate voltage falls to a ground voltage.
Figure 7:
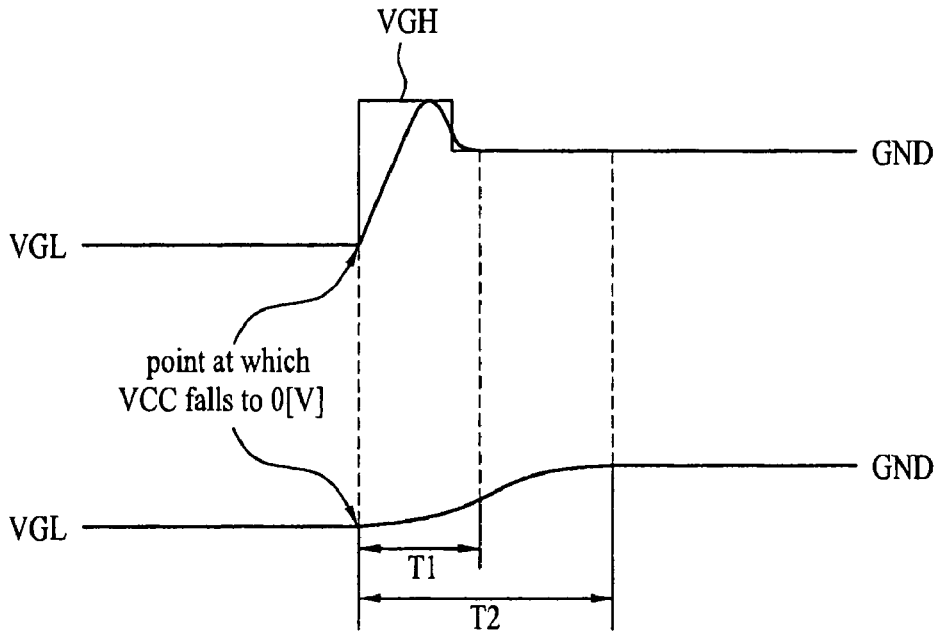
FIG. 7 shows the principle of reducing a residual image when an LCD device is turned-off.

If the user turns off the LCD device by pushing the power button again, the LCD device is operated as follows. FIG. 6 shows a point of time in which each of a source voltage, a high gate voltage, and a low gate voltage falls to a ground voltage. FIG. 7 shows the principle of reducing the residual images when the LCD device is turned-off. If the user pushes the power button in state of driving the LCD device normally, the system 210 blocks the supply of source voltage (VCC). Eventually, the source voltage (VCC) falls to the ground voltage of 0V, whereby the LCD device is turned-off.

With no source voltage (VCC), the high gate voltage (VGH) or the low gate voltage (VGL) generated by raising or lowering the source voltage (VCC) falls to the ground voltage of 0V. As shown in FIG. 6, the source voltage first falls to 0V, the low gate voltage (VGL) second falls to 0V, and the high gate voltage third falls to 0V in sequence.

At the point of time where the source voltage (VCC) falls to 0V, the low gate voltage (VGL) is applied to the other gate lines (GL) except one selected gate line (GL) of the LCD panel 217. Accordingly, at the point of time where the source voltage (VCC) falls to 0V, the auxiliary storage capacitors (Cst) of all pixels except one pixel having the selected gate line are charged with the low gate voltage (VGL). The low gate voltage (VGL) is slowly discharged due to the leakage current of the TFT provided in each pixel, whereby there is the problem of the increase of discharging time.

However, in the present invention, the discharger 215 starts to operate when the LCD device is turned-off. Therefore, the low gate voltage (VGL) is discharged from the gate line (GL) rapidly. When a source voltage (VCC) of 0V is applied to the gate terminal of the PMOS transistor (Tr502) and the gate terminal of the second NMOS transistor (Tr503), the second NMOS transistor (Tr503) is turned-off whereas the PMOS transistor (Tr502) is turned-on. Then, the high gate voltage (VGH) is applied to the gate terminal of the first NMOS transistor (Tr501) through the drain and source terminals of the PMOS transistor 502 that is turned-on. Accordingly, the first NMOS transistor (Tr501) is turned-on. Thereafter, the high gate voltage (VGH) is applied to the gate line (GL) through the drain and source terminals of the first NMOS transistor (Tr501).

After the source voltage (VCC) falls to 0V, the high gate voltage (VGH) is maintained as the predetermined value for a preset period of time, and then the high gate voltage (VGH) falls to 0V. Accordingly, the high gate voltage (VGH) applied to the gate line (GL) is maintained to a predetermined value (15V) for the preset period of time.

At the point of time where the LCD device is turned-off, the high gate voltage (VGH) applied to the gate line (GL), which corresponds to the high gate voltage (VGH) outputted from the source terminal of the first NMOS transistor (Tr501), is the pulse voltage having the predetermined amplitude and the predetermined pulse width.

The amplitude (AMP) of the pulse voltage is the same as the amplitude (AMP) of the high gate voltage (VGH). As shown in FIG. 6, the pulse width of the pulse voltage corresponds to a period (T0) between the point where the source voltage (VCC) approaches the ground voltage (GND, 0V) and the point where the high gate voltage (VGH) approaches the ground voltage (GND, 0V).

As a result, the pulse voltage applied to the gate line (GL) at the point where the LCD device is turned-off corresponds to the voltage that has the same amplitude (AMP) as that of the high gate voltage (VGH) and is maintained during the period (T0) corresponding to the pulse width.

As shown in FIG. 7, when the source voltage (VCC) falls to 0V, the voltage of the gate line (GL) momentarily rises to the high gate voltage (VGH) from the low gate voltage (VGL) due to the high gate voltage (VGH). Thereafter, the high gate voltage (VGH) falls to 0V in synchronization with the falling time, whereby the voltage of the gate line (GL) becomes 0V in a short period of time by the present invention using the discharger 215. Accordingly, the gate line (GL) is discharged in a short period of time.

As shown in FIG. 7, for the related art, the gate line (GL) is maintained as the ground voltage (GND) after the corresponding period of T2. For the present invention, the gate line (GL) is maintained as the ground voltage (GND) after the corresponding period of T1 since the low gate voltage (VGL) applied to the gate line (GL) is rapidly increased to 0V due to the high gate voltage (VGH) applied by the discharger 215. Preferably, the discharger 215 is provided in each of the gate lines (GL), so that the gate lines (GL) are rapidly and simultaneously discharged at the point of turning-off the LCD device.

Figure 8:
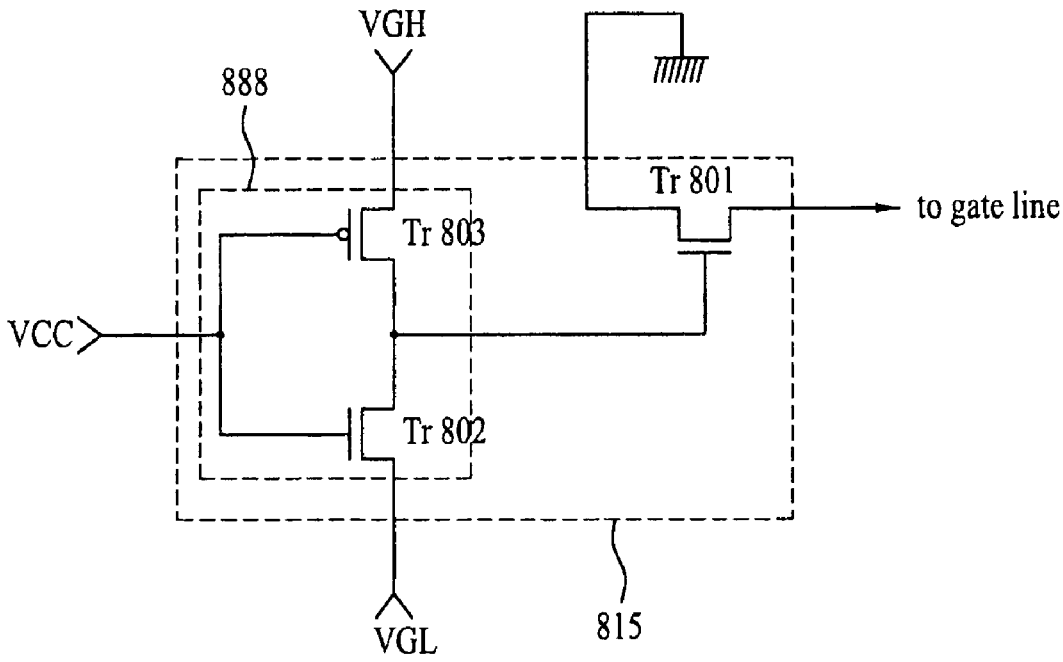
FIG. 8 is a diagram illustrating a second exemplary embodiment of the discharger according to the present invention.

Hereinafter, an LCD device according to the second embodiment of the present invention will be explained with reference to the accompanying drawings. FIG. 8 is a diagram illustrating a second exemplary embodiment of the discharger according to the present invention. Except for the structure of discharger, the LCD device for the second embodiment is the same as the LCD device for the first embodiment. As shown in FIG. 8, the discharger 815 of the LCD device according to the second embodiment of the present invention includes an inverter 888 that outputs a high gate voltage (VGH) or a low gate voltage (VGL) based on an intensity of a source voltage (VCC) and a first NMOS transistor (Tr801) that is turned-off when a low gate voltage (VGL) is outputted from the inverter 888, and is turned-on when a high gate voltage (VGH) is outputted from the inverter 888, to thereby apply the ground voltage (GND) to the gate line (GL). In this case, a drain terminal of the first NMOS transistor (Tr801) is grounded.

The inverter 888 includes a PMOS transistor (Tr802) and a second NMOS transistor (Tr803). In detail, the PMOS transistor (Tr802) includes a gate terminal having the source voltage (VCC) applied thereto and a source terminal having the high gate voltage (VGH) outputted from the DC-DC converter 216 and applied thereto. The second NMOS transistor (Tr803) includes a gate terminal connected to the gate terminal of the PMOS transistor (Tr802), a source terminal connected to the drain terminal of the PMOS transistor (Tr802), and a drain terminal having the low gate voltage (VGL) outputted from the DC-DC converter 216 and applied thereto. Also, the first NMOS transistor (Tr801) includes a gate terminal having the high gate voltage (VGH) outputted from the drain terminal of the PMOS transistor (Tr802) and applied thereto, or having the low gate voltage (VGL) outputted from the drain terminal of the second NMOS transistor (Tr803) and applied thereto, a source terminal having the low gate voltage outputted from the DC-DC converter 216 and applied thereto, and a drain terminal connected to the gate line (GL).

As mentioned above, when the LCD device is turned-off, the discharger 815 applies the ground voltage (GND) of 0V to each of the gate lines (GL). This ground voltage (GND) is larger than the low gate voltage (VGL) applied to the gate line (GL), so that the gate line (GL) is discharged in a short period of time. Preferably, the discharger 815 is provided in each of the gate lines (GL), so that the gate lines (GL) are rapidly and simultaneously discharged at the point of turning-off the LCD device.

As mentioned above, the LCD device and the method for driving the same according to the present invention have the following advantages. When the LCD device is turned-off, the pulse voltage is applied to each of the gate lines of the LCD panel, wherein the pulse voltage is higher than the low gate voltage charged in each of the gate lines, so that it is possible to discharge the gate line rapidly. Accordingly, it is possible to prevent the residual image from occurring on the screen when turning off the LCD device.

It will be apparent to those skilled in the art that various modifications and variations can be made in the liquid crystal display device and method of driving the same of the present invention without departing from the spirit or scope of the invention. Thus, it is intended that the present invention cover the modifications and variations of this invention provided they come within the scope of the appended claims and their equivalents.

What is claimed is:

1. An LCD device, comprising:

an LCD panel provided with a plurality of pixels, the pixels being defined by a plurality of gate and data lines formed perpendicularly;

an auxiliary storage capacitor formed in each of the pixels;

a gate driver to drive the gate lines in sequence by supplying a scan pulse voltage to the gate lines of the LCD panel, the scan pulse voltage being comprised of a high gate voltage and a low gate voltage; and a discharger to supply a pulse voltage to the gate line in response to a source voltage for operating the LCD panel, the pulse voltage applied to the gate line by the discharger enabling the auxiliary storage capacitor to be discharged to the ground voltage, wherein the amplitude of the pulse voltage outputted from the discharger is the same as the amplitude of the high gate voltage, wherein the amplitude of the high gate voltage is greater than the ground voltage, wherein the discharger comprises:

an inverter that selectively outputs the low gate voltage or the pulse voltage based on the intensity of the source voltage, and a first switching element that applies the pulse voltage to the gate line according to the output of the inverter, and wherein the inverter comprises:

a second switching element that outputs the pulse voltage in response to the source voltage when the applied source voltage falls to 0V, and applies the pulse voltage to a gate terminal of the first switching element to turn on the first switching element, and a third switching element that outputs the low gate voltage in response to the source voltage when the applied source voltage is maintained as a predetermined voltage value, and applies the low gate voltage to the gate terminal of the first switching element to turn off the first switching element.

2. The LCD device of claim 1, wherein the pulse width of the pulse voltage corresponds to a temporal difference between a time at which the source voltage approaches the ground voltage and a time at which the high gate voltage approaches the ground voltage.

3. The LCD device of claim 1, further comprising:

a DC-DC converter that generates various driving voltages including the low gate voltage and the high gate voltage by raising or lowering the applied source voltage and supplies the various driving voltages to the gate driver and the discharger.

4. The LCD device of claim 1, wherein each pixel includes:

a pixel electrode and a common electrode;

a storage capacitor including the pixel electrode, the common electrode, and liquid crystal, wherein the liquid crystal is provided between the pixel and common electrodes; and a thin film transistor to apply a data voltage of the data line to the pixel electrode in response to the scan pulse outputted from the gate line.

5. The LCD device of claim 1, wherein an auxiliary storage capacitor includes:

a first electrode formed of a portion of the gate line;

a second electrode formed of a portion of pixel electrode facing the portion of the gate line; and a dielectric formed of insulator positioned between the portion of the gate line and the portion of the pixel electrode.

* * * * *